US008704435B2

(12) United States Patent
Kadowaki et al.

(10) Patent No.: US 8,704,435 B2
(45) Date of Patent: Apr. 22, 2014

(54) SPARK PLUG OF INTERNAL COMBUSTION ENGINE HAVING AN EARTH ELECTRODE HAVING AN EXPOSED SIDE SURFACE ON A PROJECTING PART

(75) Inventors: Satoru Kadowaki, Mie-gun (JP); Toshikazu Shimizu, Okazaki (JP)

(73) Assignee: Denso Corporation, Kariya ( * ) Notice: Subject to any disclaimer, the term of this patent is extended or adjusted under 35 U.S.C. 154(b) by 0 days.

(21) Appl. No.: 13/540,701

(22) Filed: Jul. 3, 2012

(65) Prior Publication Data

US 2013/0009536 A1 Jan. 10, 2013

(30) Foreign Application Priority Data

Jul. 5, 2011 (JP) ..... 2011-148947
Mar. 21, 2012 (JP) ..... 2012-062981

(51) Int. Cl.
*H01T 13/32* (2006.01)
*H01T 13/39* (2006.01)

(52) U.S. Cl.
USPC ..... 313/142; 313/141

(58) Field of Classification Search
USPC ..... 313/118, 141, 142, 311
See application file for complete search history.

(56) References Cited

U.S. PATENT DOCUMENTS

2010/0213812 A1* 8/2010 Kawashima et al. ..... 313/141
2010/0289397 A1 11/2010 Hanashi et al.
2012/0146483 A1 6/2012 Kadowaki

FOREIGN PATENT DOCUMENTS

JP 2009-054574 3/2009
JP 2009-054579 3/2009
JP 2012-129026 7/2012

* cited by examiner

*Primary Examiner* — Nimeshkumar Patel
*Assistant Examiner* — Steven Horikoshi
(74) *Attorney, Agent, or Firm* — Nixon & Vanderhye P.C.

(57) ABSTRACT

A spark plug has a cylindrical housing case, a cylindrical glass insulator, a center electrode, and an earth electrode fixed to the cylindrical housing case. The earth electrode has a projected part which is projected toward the center electrode. The projected part has a facing surface which faces the center electrode and is most close to the center electrode in a spark discharge gap. This gap is formed between the center electrode and the earth electrode. The facing surface is covered with a plating layer. A base material, with which the earth electrode is made, is exposed on a side surface of the projected part around the facing surface of the projected part. The base material of the earth electrode is made of Ni alloy containing not less than 90 wt % Ni, and preferably, Ni within a range of 90 wt % to 98 wt %.

5 Claims, 10 Drawing Sheets

SPARK PLUG OF INTERNAL COMBUSTION ENGINE HAVING AN EARTH ELECTRODE HAVING AN EXPOSED SIDE SURFACE ON A PROJECTING PART

CROSS-REFERENCE TO RELATED APPLICATION

This application is related to and claims priority from Japanese Patent Applications No. 2011-148947 filed on Jul. 5, 2011, and No. 2012-062981 filed on Mar. 21, 2012, the contents of which are hereby incorporated by reference.

BACKGROUND OF THE INVENTION

1. Field of the Invention

The present invention relates to spark plugs for use in various types of internal combustion engines.

2. Description of the Related Art

There are spark plugs for use in various types of devices and systems. For example, a spark plug is applied to an internal combustion engine mounted to a motor vehicle. Such a spark plug is a device for delivering electric current from an ignition system to a combustion chamber of then internal combustion engine in order to ignite air fuel mixture gas introduced into the combustion chamber. The spark plug has a center electrode and an earth electrode, in which a spark discharge gap is formed between the center electrode and the earth electrode. A projected part is formed on the earth electrode at the side which faces the center electrode, specifically, is close to the center electrode. For example, conventional techniques, disclosed in Japanese patent laid open publication No. JP 2009-054574 and disclosed in Japanese patent laid open publication No. JP 2009-054579, which show spark plugs having a projected part. The projected part is formed by deforming a part of base material of the earth electrode.

However, the structure of such a conventional spark plug having the projected part deformed at a part of the earth electrode causes a drawback of easily consuming the projected part of the earth electrode by a repetition of spark discharges. This increases the dimension of the gap of the spark discharge formed between the center electrode and the earth electrode in the conventional spark plug. As a result, this often shortens the life of the spark plug.

In order to solve the above drawback, one conventional technique has proposed an improved spark plug having an earth electrode with a projected part. The earth electrode and the projected part are plated with a thin metal layer in order to increase a wear resistance capability of the projected part and also to increase the life of the spark plug. Because the plating layer has in general a high hardness, it is possible to protect the surface of the projected part formed on the earth electrode of the spark plug.

Further, because the plating layer has a low thermal conductivity, it is difficult to discharge heat energy of the projected part of the earth electrode to outside, and as a result the temperature of the projected part of the earth electrode is thereby increased. This promotes activity of electrons around the projected part of the earth electrode, and increases the sparkability and ignitability around the projected part of the earth electrode in a spark plug.

However, the structure of the earth electrode in which the entire surface of the projected part is covered with the plating layer having a low thermal conductivity causes a drawback of it being difficult to quickly discharge thermal energy from the projected part having a high temperature of the earth electrode after spark discharge. This shortens the life of the projected part of the earth electrode, and easily consumes the life of the projected part of the earth electrode of the spark plug. As a result, this shortens the life of the spark plug.

SUMMARY

It is therefore desired to provide a spark plug having an improved structure and an increased sparkability and ignitability, and to have prolonged life. The spark plug can be applied to various types of internal combustion engines.

An exemplary embodiment provides a spark plug having a cylindrical housing case, a cylindrical glass insulator, a center electrode, and an earth electrode. The cylindrical glass insulator is supported by the inside of the cylindrical housing case. The center electrode is supported in the inside of the cylindrical glass insulator so that a front part of the center electrode is exposed toward the outside of the spark plug. The earth electrode is fixed to the cylindrical housing case. A spark discharge is generated at a spark discharge gap formed between the earth electrode and the center electrode. The spark plug according to the exemplary embodiment is applicable to various types of internal combustion engines. In particular, the earth electrode has a projected part which is projected toward the center electrode. The projected part of the earth electrode has a facing surface. The facing surface of the projected part faces the center electrode, specifically, the facing surface is closest to the front part of the center electrode in the spark discharge gap. The spark discharge gap is formed between the center electrode and the earth electrode. The facing surface of the projected part of the earth electrode is covered with a plating layer. A base material of the earth electrode is exposed on a side surface of the projected part around the facing surface of the projected part of the earth electrode.

In the structure of the earth electrode in the spark plug according to the exemplary embodiment, the facing surface of the projected part is plated, specifically, covered with a plating layer. The facing surface of the projected part faces the center electrode of the spark plug in the spark discharge gap. This makes it possible to protect the projected part of the earth electrode form being consumed by spark discharge. That is, spark discharge is generated in the spark discharge gap which is formed between the center electrode and the facing surface of the projected part of the earth electrode. In the spark discharge gap, the facing surface of the projected part faces the center electrode. Because the facing surface of the projected part of the earth electrode is covered with the plating layer, it is possible to protect the facing surface of the projected part from being consumed or damaged and destroyed by a repetition of spark discharge. That is, to form the plating layer on the facing surface of the projected part of the earth electrode makes it possible to protect the projected part from being consumed or damaged by the spark discharge because the plating layer covering the facing surface of the projected part of the earth electrode has a hardness (for example, Vickers hardness) which is higher than that of the base material of the earth electrode. As a result, this structure makes it possible to protect the spark discharge gap from being expanded or increased, and to prolong the life of the spark plug. The exemplary embodiment of the present invention provides the spark plug to have a long life.

Further, the presence of the plating layer on the facing surface of the projected part of the earth electrode can increase the sparkability and ignitability of the spark plug. That is, to form the plating layer on the facing surface of the projected part of the earth electrode prevents heat energy from being discharged from the facing surface of the projected part because the plating layer has a low thermal conductivity. This keeps the facing surface of the projected part at a high temperature. As a result, this promotes activity of electrons around the projected part of the earth electrode, and increases the sparkability and ignitability of the spark plug.

On the other hand, the base material of the earth electrode is exposed on the side surface of the projected part of the earth electrode. That is, the side surface of the projected part is not covered with any plating layer. This structure makes it possible to promote discharging of heat energy generated in the projected part through the side surface of the projected part of the earth electrode. This makes it further possible to protect the projected part of the earth electrode from being overheated and to keep the wear resistance capability of the projected part.

By the way, if the entire surface of the projected part of the earth electrode is plated, specifically, is covered with the plating layer, it is difficult to quickly discharge heat energy of the projected part of the earth electrode generated by spark discharge after the spark discharge, and to easily consume the projected part of the earth electrode by a repetition of the spark discharge. This shortens the life of the projected part of the earth electrode of the spark plug.

On the other hand, in the structure of the spark plug according to the exemplary embodiment, the side surface of the projected part of the earth electrode is not plated, specifically, is not covered with any plating layer. Further, the base material of the earth electrode is exposed to the outside atmosphere from the side surface of the projected part of the earth electrode. This makes it possible to quickly discharge heat energy of the projected part from the side surface of the projected part of the earth electrode after spark discharge. It is thereby possible to keep the wear resistance capability of the projected part of the earth electrode, and to provide the spark plug to have a long life.

The spark plug having the above improved and novel structure according to the exemplary embodiment can be used for various types of internal combustion engines, for example, can be applied to internal combustion engines mounted to motor vehicles.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
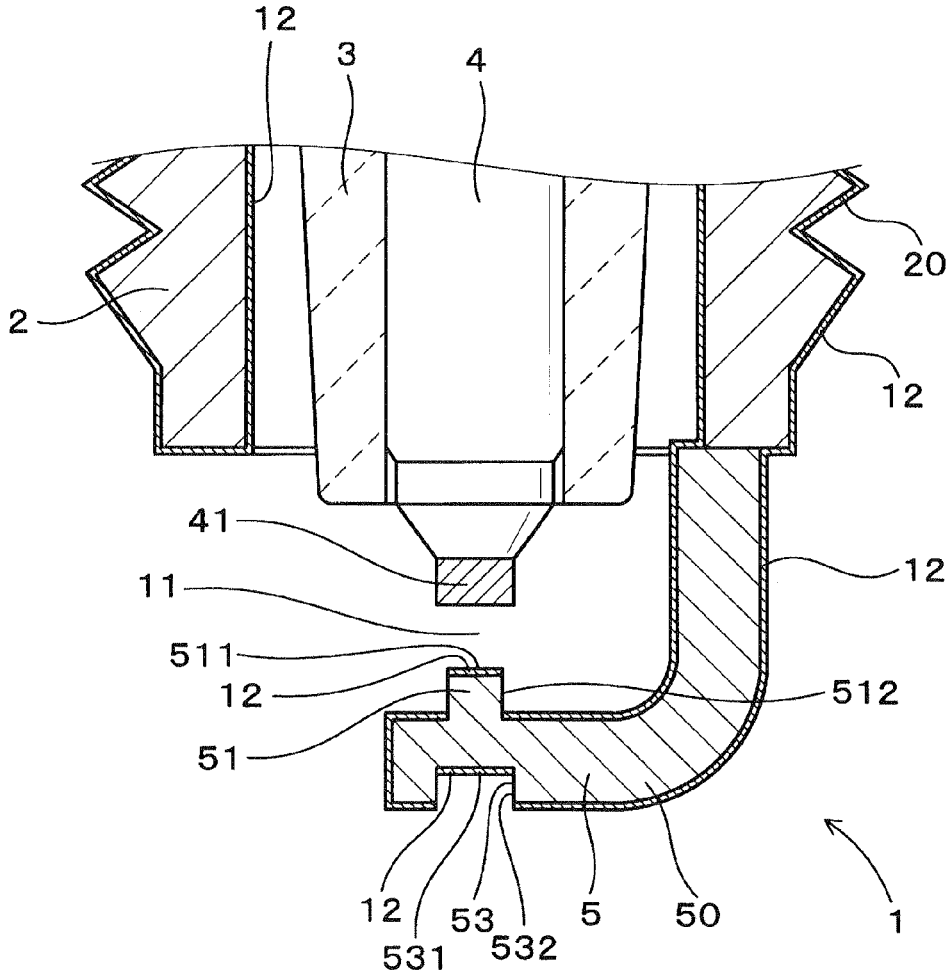
FIG. 1 is an enlarged view showing a longitudinal cross section of a front part of a spark plug according to a first exemplary embodiment of the present invention.

Hereinafter, various embodiments of the present invention will be described with reference to the accompanying drawings. In the following description of the various embodiments, like reference characters or numerals designate like or equivalent component parts throughout the several diagrams.

A description will be given of a structure, features and effects of the spark plug according to the present invention.

In the improved and novel structure of the spark plug according to the present invention, the surface of the projected part in the earth electrode other than the side surface of the projected part are covered with the plated surface.

It is preferable for the spark plug to have a structure in which the surface of the earth electrode other than the projected part is covered with the plating layer made of the same material of the plating layer formed on the facing surface of the projected part of the earth electrode. This structure of the earth electrode of the spark plug makes it possible to form the plating layer of the earth electrode and the plating layer of the facing surface of the projected part of the earth electrode, simultaneously.

It is preferable that the surface of the cylindrical cover case in the spark plug according to the present invention is covered with the plating layer. It is further preferable that this plating layer is made of the same material of the plating layer with which the facing surface of the projected part of the earth electrode is covered. This makes it possible to simultaneously form the plating layer of the cylindrical housing case and the plating layer on the facing surface of the projected part of the earth electrode.

It is possible for the spark plug to have the earth electrode produced by a deformation process so that the projected part extracted from the surface of the earth electrode projects toward the center electrode in the spark discharge gap. For example, it is possible to form the projected part by pressing a part of the earth electrode at the facing surface of the earth electrode toward the center electrode. This makes the projected part on the earth electrode, which faces the center electrode, and also makes a cavity part on the earth electrode, which is counter to the earth electrode.

Further, it is possible to execute the deformation process to deform the earth electrode in order to produce the projected part after forming the plating layer on the base material of the earth electrode. This process makes it possible to form the side surface of the projected part so that the base material is exposed on the side surface without being covered with any plating layer because the side surface becomes a shear surface by pressing. It is accordingly possible to produce the structure of the earth electrode of the spark plug in which the projected part has the facing surface which faces the spark discharge gap toward the center electrode, and is plated (or is covered with the plating layer), and the projected part has the side surface on which the base material of the earth electrode is exposed.

Still further, although a bottom surface of the cavity part of the earth electrode, which is an opposite surface of the facing surface, is covered with the plating layer, the base material of the earth electrode is exposed on the side surface of the cavity part.

It is preferable that the plating layer (with which the facing surface of the earth electrode is covered and the bottom surface of the cavity part of the earth electrode is also covered) is made of nickel alloy which contains not less than 90% nickel (Ni). It is also preferable that the base material of the earth electrode is made of Ni alloy containing Ni within a range of 90 wt % to 98 wt %. This structure of the plating layer, with which the facing surface of the projected part of the earth electrode is covered, makes it possible to increase the adhesion capability on the projected part of the earth electrode.

First Exemplary Embodiment

A description will now be given of a spark plug 1 according to the first exemplary embodiment of the present invention with reference to FIG. 1 to FIG. 7.

Figure 2:
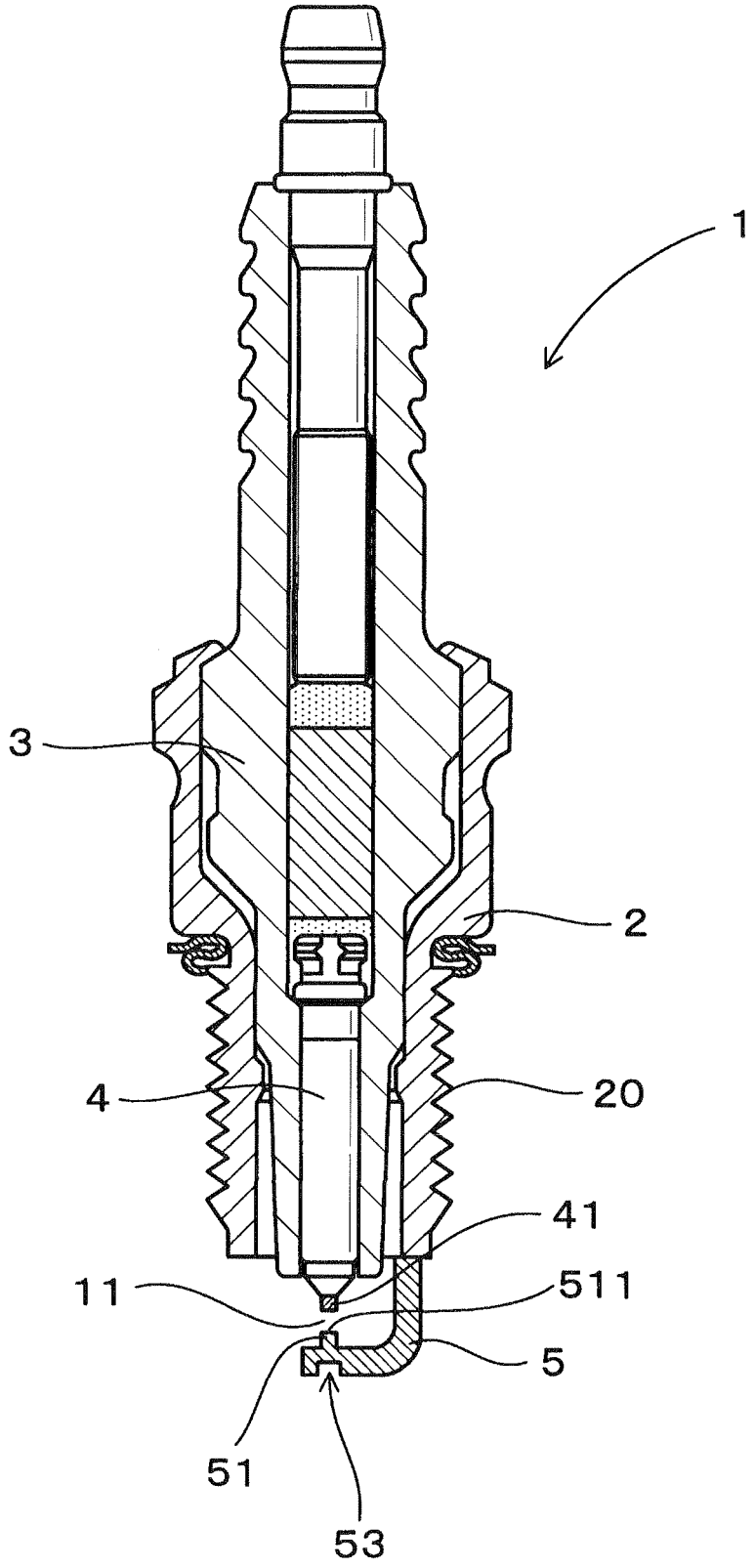
FIG. 2 is a view showing a longitudinal cross section of an entire structure of the spark plug according to the first exemplary embodiment of the present invention.

FIG. 1 is an enlarged view showing a longitudinal cross section of a front part of the spark plug 1 according to the first exemplary embodiment of the present invention. FIG. 2 is a view showing a longitudinal cross section of an entire structure of the spark plug 1 according to the first exemplary embodiment.

As shown in FIG. 2, the spark plug 1 can be applied to various types of internal combustion engines. The spark plug 1 has a cylindrical housing case 2, a cylindrical glass insulator 3, a center electrode 4, and an earth electrode 5. The cylindrical glass insulator 3 is supported by the inside of the cylindrical housing case 2. The center electrode 4 is supported in the inside of the cylindrical glass insulator so that a front part of the center electrode 4 is exposed to the outside of the spark plug 1. The earth electrode 5 is fixed to the cylindrical housing case 2. A spark discharge is generated at a spark discharge gap 11 formed between the earth electrode 5 and the center electrode 4. In particular, the spark plug 1 can be applied to various types of internal combustion engines.

As shown in FIG. 1, the earth electrode 5 has a projected part 51 formed by a deforming process so that the projected part 51 projects toward the center electrode 4. The projected part 51 of the earth electrode 5 has a facing surface 511. The facing surface 511 of the projected part 51 faces the spark discharge gap 11 toward the center electrode 4. As shown in FIG. 1, the facing surface 511 is closest to a front part of the center electrode 4 in the spark discharge gap 11. The facing surface 511 of the projected part 51 is plated, specifically, is covered with a plating layer 12. A base material 50 of the earth electrode 5 is exposed on a part of the earth electrode 5. A shown in FIG. 1, the base material 50 is exposed on a side surface 512 around the facing surface 511 of the projected part 51 of the earth electrode 5.

For example, the spark plug 1 according to the first exemplary embodiment can be applied as an ignition unit to internal combustion engines for use in motor vehicles, co-generation systems, and pressure feed gas pump, etc.

As shown in FIG. 2, the spark plug 1 is fixed to a wall of a combustion chamber (not shown) of the internal combustion engine by a screw unit 20. The screw unit 20 is formed on the outside of the cylindrical housing case 2. The cylindrical housing case 2 is made of carbon steel, etc., for example, and approximately has a cylindrical shape.

The cylindrical glass insulator 3 is supported in the inside of the cylindrical housing case 2. For example, the cylindrical glass insulator 3 approximately has a cylindrical shape. The cylindrical glass insulator 3 is made of ceramics such as alumina. The center electrode 4 is supported in the inside of the cylindrical glass insulator 3. The center electrode 4 is composed of a center electrode base material 40 and a front part made of noble metal chip 41. The noble metal chip 41 approximately has a cylindrical shape and made of Ir, Rh or Ru, etc. That is, the noble metal chip 41 is formed at the front part of the center electrode 4. The noble metal chip 41 projects from the front part of the center electrode 4 toward the spark discharge gap 11.

Figure 3:
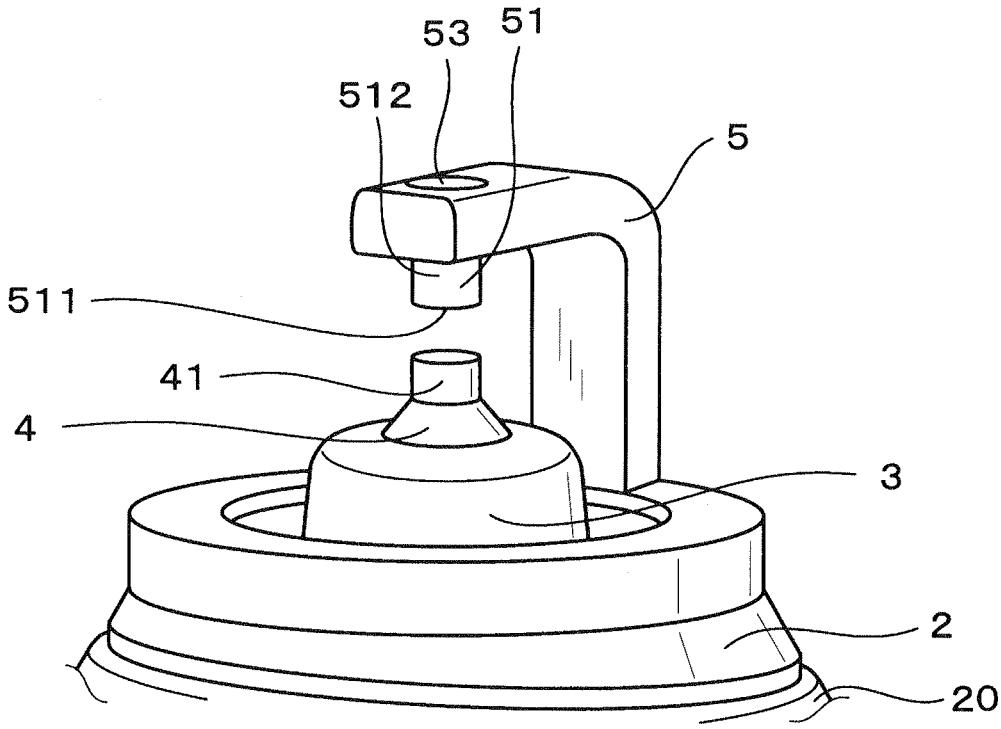
FIG. 3 is a perspective view of the front part of the spark plug according to the first exemplary embodiment of the present invention.

FIG. 3 is a perspective view of the front part of the spark plug 1 according to the first exemplary embodiment of the present invention.

As shown in FIG. 1, FIG. 2 and FIG. 3, one end part of the earth electrode 5 is contacted with the front part of the cylindrical housing case 2. The earth electrode 5 is bent so that the projected part 51 formed on the front part of the earth electrode 5 faces the noble metal chip 41 formed on the front part of the center electrode 4.

The projected part 51 of the earth electrode 5 approximately has a cylindrical shape and formed on the front part of the earth electrode 5 so that the projected part 51 faces the noble metal chip 41 formed on the front part of the center electrode 4. The projected part 51 has a diameter within a range of 1.3 to 1.5 mm, a projected size within a range of 0.5 to 0.8 mm.

As shown in FIG. 1, the plating layer 12 formed on the surface of the projected part 51 is made of Ni. The base material 50 of the earth electrode 5 is made of Ni alloy, and the surface of the earth electrode 5 other than the projected part 51 is covered with the plating layer 12. In the structure of the spark plug 1 according to the first exemplary embodiment, such Ni alloy which forms the base material 50 contains not less than 90% Ni, and Si, Y and Ti. Specifically, the Ni alloy forming the base material 50 of the earth electrode 5 has Ni of 98 wt %, Si within a range of 0.7 to 1.3 wt %, Y within a range of 0.05 to 0.2 wt %, and Ti within a range of 0.2 to 0.1 wt %.

As shown in FIG. 1, the cavity part 53 is formed on the back surface of the earth electrode 5, which is opposite to the projected part 51 along an axial direction of the spark plug 1.

Figure 4:
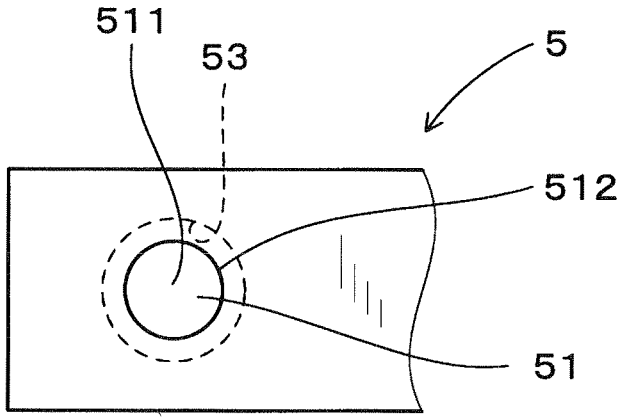
FIG. 4 is a plan view showing a facing surface of a projected part formed on a front part of an earth electrode in the spark plug according to the first exemplary embodiment of the present invention.

FIG. 4 is a plan view showing the facing surface 511 of the projected part 51 formed on the front part of the earth electrode 5 in the spark plug 1 according to the first exemplary embodiment of the present invention.

As shown in FIG. 3 and FIG. 4, each of the projected part 51 and the cavity part 53 has approximately a cylindrical shape.

As shown in FIG. 1, the plating layer 12 is formed on the facing surface 511 of the projected part 51. The plating layer is further formed on other surfaces of the earth electrode 5. For example, the plating layer 12 is formed on various surfaces of the earth electrode 5 other than the side surfaces 512 of the projected part 51 and the side surface 532 of the cavity part 53. In other words, the base material 50 is exposed on the side surface 512 of the projected part 51 and the side surface 532 of the cavity part 53 of the earth electrode 5.

Although the bottom surface 531 of the cavity part 53 is covered with the plating layer, the side surface 532 of the cavity part 53 is not covered with any plating layer. The base material is exposed on the side surface 532 of the cavity part 53 of the earth electrode 5. That is, the side surface 512 of the projected part 51 and the side surface 532 of the cavity part 53 are not covered with any plating layer.

In addition, the surface of the cylindrical housing case 2 is covered with the plating layer 12. That is, the plating layer 12 covers the entire of the cylindrical housing case 2 which contains the inner peripheral surface and the screw unit 20 of the cylindrical housing case 2.

The plating layer 12 of the cylindrical housing case 2 is made of the same material of the plating layer 12 formed on the surface of the earth electrode 5. In the first exemplary embodiment, the plating layer 12 is made of Ni. The thickness of the plating layer 12 is within a range of 4 μm to 28 μm.

It is possible for the spark plug 1 according to the first exemplary embodiment to have a structure in which the plating layer 12 has a Vickers hardness which is higher than the Vickers hardness of the base material 50 of the earth electrode 5. For example, the base material has the Vickers hardness within a range of 100 Hv to 150 Hv, and the plating layer 12 has a Vickers hardness within a range of 500 Hv to 600 Hv.

Further, the plating layer 12 has a low thermal conductivity which is lower than a thermal conductivity of the base material 50 of the earth electrode 5. For example, the base material 50 of the earth electrode 5 has a thermal conductivity within a range of 60 W/mK to 70 W/mK, and on the other hand, the plating layer 12 has a thermal conductivity within a range of 40 W/mK to 50 W/mK.

A description will now be given of the method of producing the spark plug 1 according to the first exemplary embodiment with reference to FIG. 5A to FIG. 7B.

Figure 5A:
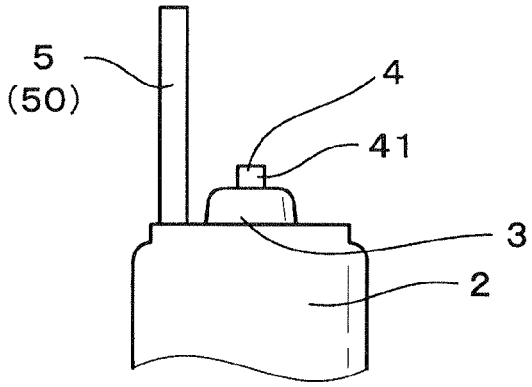
FIG. 5A is a view which explains the front part of the spark plug before forming the projected part and a cavity part in the earth electrode.
Figure 5B:
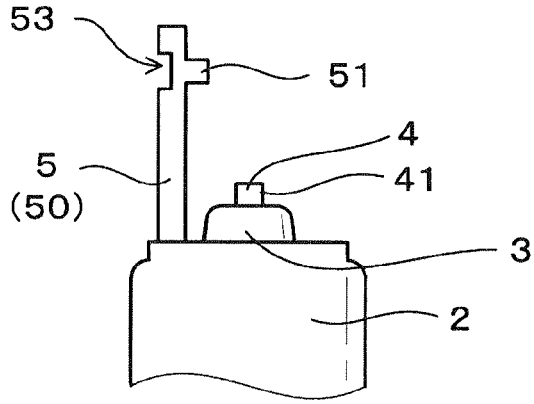
FIG. 5B is a view which explains the front part of the spark plug after forming the projected part and the cavity part in the earth electrode.
Figure 5C:
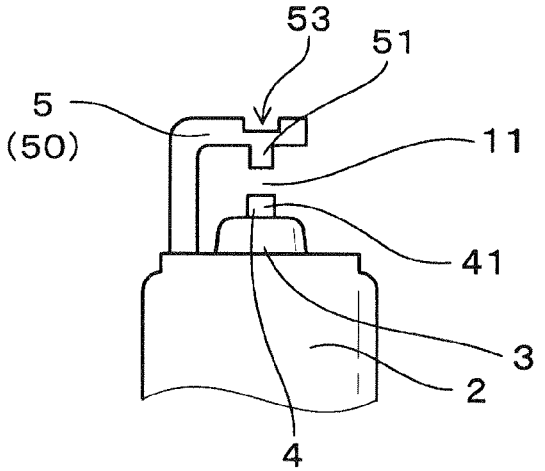
FIG. 5C is a view which explains the front part of the spark plug after a spark discharge gap is formed between a center electrode and the earth electrode with the projected part and the cavity part.

FIG. 5A is a view which explains the front part of the spark plug 1 before forming the projected part 51 and the cavity part 53 in the earth electrode 5. FIG. 5B is a view which explains the front part of the spark plug 1 after forming the projected part 51 and the cavity part 53 in the earth electrode 5. FIG. 5C is a view which explains the front part of the spark plug 1 after forming the spark discharge gap 11 between the center electrode 4 and the earth electrode 5 with the projected part 51 and the cavity part 53.

Figure 10:
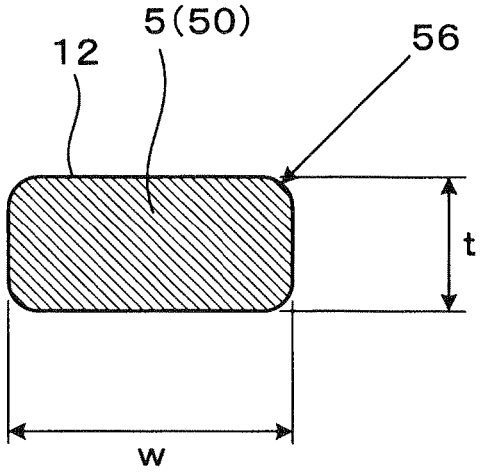
FIG. 10 is a view showing a cross section of the earth electrode of the spark plug as the first experiment.

First, the base material 50 of the earth electrode 5 having a rod shape, for example, shown in FIG. 10, is joined and fixed to the front surface of the cylindrical housing case 2 by using laser welding.

FIG. 10 is a view showing a cross section of the earth electrode 5 of the spark plug 1 used in the first experiment. FIG. 5A shows the base material 50 of the earth electrode 5 fixed to the front surface of the cylindrical housing case 2 so that the base material 50 of the earth electrode 5 is aligned in parallel to an axial direction of the cylindrical housing case 2.

Next, the surface of the cylindrical housing case 2 and the surface of the base material 50 are plated by nickel plating using electroplating or electroless plating (or electroless deposition). The entire surface of the cylindrical housing case 2 and the entire surface of the base material 50 of the earth electrode 5 are coveted with the plating layer 12.

Figure 7A:
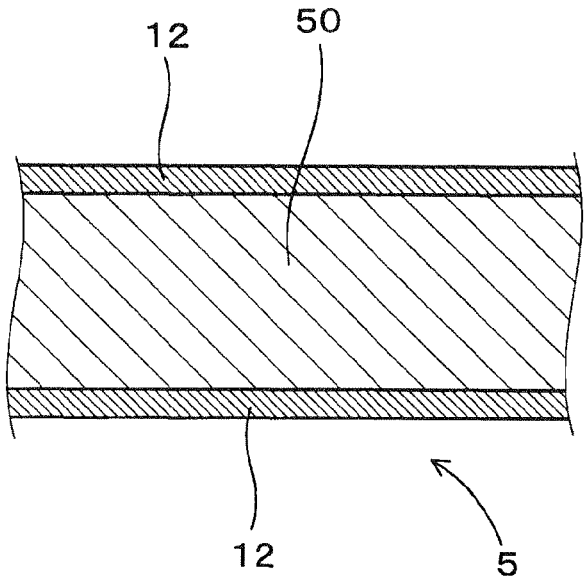
FIG. 7A is a view showing a partial cross section of the earth electrode of the spark plug before forming the projected part according to the first exemplary embodiment of the present invention.
Figure 7B:
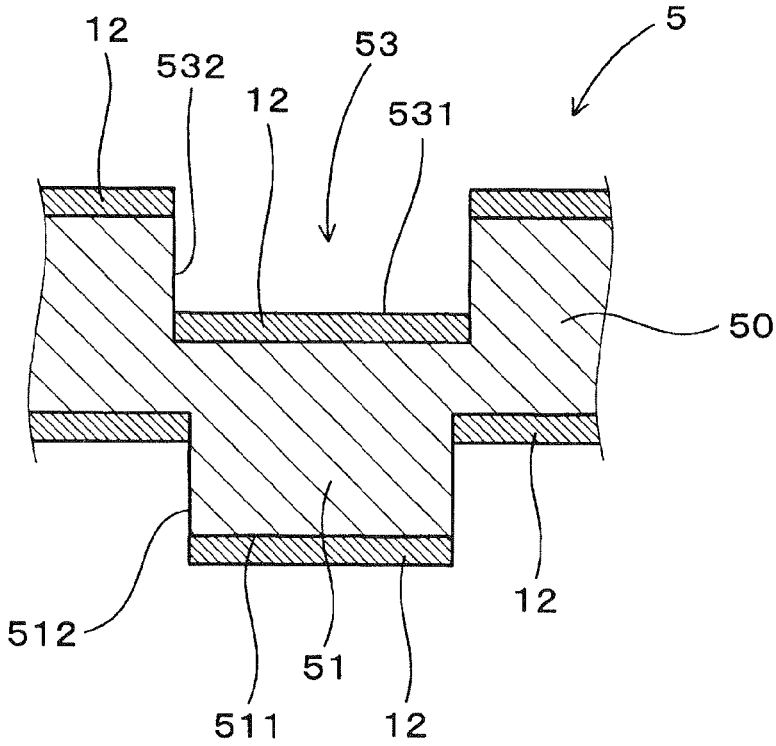
FIG. 7B is a view showing a partial cross section of the earth electrode after forming the projected part on the earth electrode in the spark plug according to the first exemplary embodiment of the present invention.

FIG. 7A is a view showing a partial cross section of the earth electrode 5 of the spark plug 1 before forming the projected part 51 according to the first exemplary embodiment. FIG. 7B is a view showing a partial cross section of the earth electrode 5 after forming the projected part 51 on the earth electrode 5 in the spark plug 1 according to the first exemplary embodiment.

As shown in FIG. 7A, the base material 50 of the earth electrode 5 is covered with the plating layer 12. That is, this can avoid using any masking during the plating process.

Next, as shown in FIG. 5A, the center electrode 4 and the insulation glass 3 are inserted and installed in the inside of the cylindrical housing case 2 to which the earth electrode 5 having the projected part 51 which is covered with the plating layer 12.

Next, as shown in FIG. 5B, the projected part 51 is formed on the front part of the earth electrode 5 by using deforming press so that the projected part 51 is projected from the earth electrode 5 toward the center electrode 4.

Figure 6:
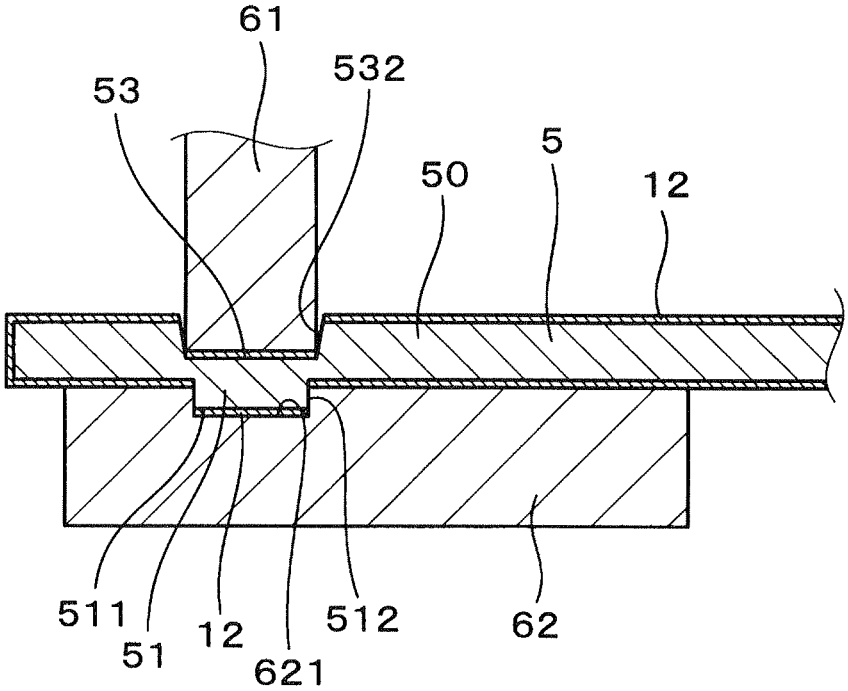
FIG. 6 is a view showing a method of forming the projected part on the earth electrode of the spark plug according to the first exemplary embodiment of the present invention.

FIG. 6 is a view showing a method of forming the projected part 51 on the earth electrode 5 of the spark plug 1 according to the first exemplary embodiment.

As shown in FIG. 6, the projected part 51 is formed on the earth electrode 5 by using a punch 61 and a metal die 62. The metal die 62 has a cavity part 621 which corresponds to the shape of the projected part 51 of the earth electrode 5. That is, the earth electrode 5 is placed on the metal die 62 so that the cavity part 621 is covered with the earth electrode 5 of the rod shape. After this, the punch 61 is forcedly pushed and pressed on the earth electrode 5 toward the metal die 62 in order to form the cavity part 53 on the back surface of the earth electrode 5 and the projected part 51 on the front surface of the earth electrode 5.

At this time, as shown in FIG. 7B, because the side surface 512 of the projected part 51 is cut by the inner side surface of the cavity part 621 of the metal die 62, a shear surface is formed on the side surface 512 of the projected part 51 of the earth electrode 5. The base material 50 of the earth electrode 5 is exposed on the side surface 512 of the projected part 51 of the earth electrode 5. Similarly, the shear surface is also cut by the side surface of the punch 61 and a shear surface is formed on the side surface 532 of the cavity part 53 of the earth electrode 5. The base material 50 of the earth electrode 5 is exposed on the side surface 532 of the earth electrode 5. Other surfaces of the earth electrode are covered with the plating layer 12.

Figure 8:
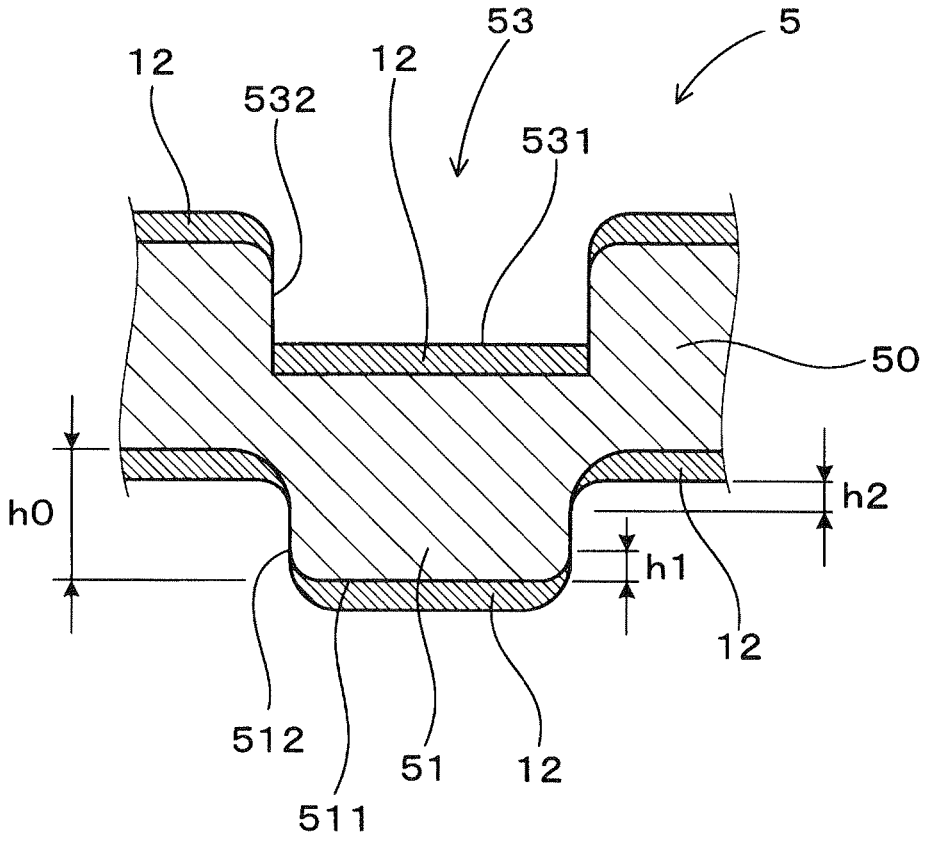
FIG. 8 is a view showing a partial cross section of dulled part and wicking generated around the projected part of the earth electrode caused by press working.

FIG. 8 is a view showing a partial cross section of dulled part and wicking generated around the projected part 51 of the earth electrode 5 caused by press working.

In a concrete example, as shown in FIG. 8, such press working generates curved parts at the rising part of the projected part (or convex part) 51 and the edge part of the facing surface 511. This often causes a plate dulling. However, even if such a plate dulling is generated in the projected part 51 and the cavity part 53, there is no problem and it is possible to have the superb effects of the present invention so long as the base material 50 of the earth electrode 5 is adequately exposed on the side surface 512 of the projected part 51 of the earth electrode 5.

It is preferable for the spark plug 1 according to the first exemplary embodiment to have a relationship between a height "h1" of the plate dulling at the edge part of the facing surface 511 of the projected part 51 and a height "h2" of the plate dulling formed at the rising edge of the projected part 51 so that each of the height "h1" and the height "h2" is not more than 25% of a height "h0" of the projected part 51, as shown in FIG. 8.

Next, the earth electrode 5 installed in parallel to an axial direction of the cylindrical housing case 2, as shown in FIG. 5B, is bent at a predetermined position of the earth electrode 5, as shown in FIG. 5C. That is, the earth electrode 5 is bent, toward the center axis of the cylindrical housing case 2, at a position which is a distal end side observed from the projected part 51 formed at a front part of the earth electrode 5. That is, the earth electrode 5 of a rod shape is bent so that the projected part 51 of the earth electrode 5 faces the noble metal chip 41 of the center electrode 4. After this, the spark discharge gap 11 formed between the center electrode 4 and the projected part 51 of the earth electrode 5 is adjusted so as to have a predetermined length. This completes the production of the spark plug 1 according to the first exemplary embodiment.

A description will now be given of the actions and effects of the spark plug 1 having the above improve structure according to the first exemplary embodiment.

In the structure of the spark plug 1 to be applied to various types of internal combustion engines, as shown in FIG. 1, the facing surface 511 of the projected part 51 of the earth electrode 5 is covered with the plating layer 12. The formation of the plating layer 12 on the projected part 51 protects the projected part 51 from being damaged and consumed by a repetition of spark discharge. That is, the facing surface 511 of the projected part 51 of the earth electrode 5 becomes a discharge surface, and spark discharge is generated in the spark discharge gap formed between the center electrode 4 and the facing surface 511 of the projected part 51 of the earth electrode 5. The presence of the plating layer 12 can protect the projected part 51 of the earth electrode 5 from being damaged and consumed by repetition of spark discharge. The plating layer 12 formed on the facing surface 511 of the projected part 51 has a hardness (for example, a Vickers hardness) which is higher than that of the base material 50 of the earth electrode 50. This structure can protect the projected part 51 of the earth electrode 5 from being damaged and consumed by a repetition of spark discharge. As a result, it is possible to protect the spark discharge gap 11 from being expanded, and to extend the life of the spark plug 1 according to the first exemplary embodiment to have a long life.

Further, the formation of the plating layer 12 with which the facing surface 511 of the projected part 51 is covered can increase the sparkability and ignitability of the spark plug 1. Although the plating layer 12 has a low thermal conductivity, the formation of the plating layer 12 on the facing surface 511 of the projected part 51 can prevent thermal energy of the projected part 51 from being discharged, and promotes the increase of the temperature around the facing surface 511 of the projected part 51. As a result, the increase of the temperature makes it possible to activate electrons around the projected part 51 of the earth electrode 5 and to increase the sparkability and ignitability of the spark plug 1.

On the other hand, the base material 50 is exposed at the side surface 512 of the projected part 51 of the earth electrode 5. In other words, the side surface 511 of the projected part 51 is not covered with any plating layer. This makes it possible to easily discharge the heat energy from the side surface 512 of the projected part 51 of the earth electrode 5. This can protect the projected part 51 of the earth electrode 5 from being overheated, and keeps the wear resistance of the projected part 51 of the earth electrode 5. That is, if the entire surface of the projected part 5 is completely covered with the plating layer 12, the projected part 51 has an excess temperature and this becomes difficult to quickly discharge the heat energy of the projected part 51 after spark discharge, and this promotes the damage of the projected part 51. As a result, this shortens the life of the spark plug.

In order to avoid the above drawbacks, the first exemplary embodiment provides the spark plug 1 having the superb and novel structure in which the side surface 512 of the projected part 51 of the earth electrode 5 is not covered with any plating layer, and the base material 50 of the earth electrode 5 is exposed at the side surface 511 of the projected part 51. This structure makes it possible to quickly discharge heat energy of the projected part 5 generated by spark discharge after the spark discharge. As a result, it is possible to keep the wear resistance of the projected part 51 of the earth electrode 5 and to prolong the life of the spark plug. The first exemplary embodiment provides the spark plug 1 to have a long life.

In the structure of the spark plug 1 according to the first exemplary embodiment, the plating layer 12 is made of Ni, and the base material 50 of the earth electrode 5 is made of Ni alloy which contains Ni of not less than 90 wt %. This structure makes it possible to increase the adhesion of the plating layer 12 onto the projected part 51 of the earth electrode 5. This feature will be explained later in detail, specifically, in the "first experiment section".

As previously described, the first exemplary embodiment provides the spark plug 1 to have a long life and the increased sparkability and ignitability for use in various types of internal combustion engines.

Second Exemplary Embodiment

A description will be given of the spark plug according to the second exemplary embodiment of the present invention.

In the spark plug according to the second exemplary embodiment, the base material 50 of the earth electrode 5 is made of Ni alloy having a composition which is different from the composition of Ni alloy of the base material used in the spark plug 1 according to the first exemplary embodiment.

That is, the spark plug according to the second exemplary embodiment has the earth electrode 5 with the projected part 51 made of the base material 50. The base material 50 is made of Ni alloy which contains Ni of 95 wt %, Cr within a range of 1.5 to 2.0 wt %, Mn within a range of 10.0 to 1.25 wt %, Si within a range of 1.0 to 1.25 wt %, and S of 0.01 wt %.

The spark plug according to the second exemplary embodiment having the above structure has the same actions and effect of the spark plug 1 according to the first exemplary embodiment.

Third Exemplary Embodiment

A description will be given of the spark plug according to the third exemplary embodiment of the present invention.

In the spark plug according to the third exemplary embodiment, the base material 50 of the earth electrode 5 is made of Ni alloy having a composition which is different from the composition of Ni alloy of the base material used in each of the spark plugs according to the first and second exemplary embodiments previously described.

That is, the spark plug according to the third exemplary embodiment has the earth electrode 5 with the projected part 51 made of the base material 50. The base material 50 is made of Ni alloy which contains Ni of 90 wt % and Cr within a range of 5 to 10 wt %.

The spark plug according to the third exemplary embodiment having the above structure has the same actions and effect of the spark plug according to the first exemplary embodiment.

Fourth Exemplary Embodiment

A description will be given of the spark plug according to the fourth exemplary embodiment of the present invention.

In the spark plug according to the fourth exemplary embodiment, the base material 50 of the earth electrode 5 is made of Ni alloy having a composition which is different from the composition of Ni alloy of the base material used in each of the spark plugs according to the first, second, and third exemplary embodiments previously described.

That is, the spark plug according to the fourth exemplary embodiment has the earth electrode 5 with the projected part 51 made of the base material 50. The base material 50 is made of Ni alloy composed of Ni of 85 wt % and Fe within a range of 2 to 5 wt %.

The spark plug according to the fourth exemplary embodiment having the above structure has the same actions and effect of the spark plug according to the first exemplary embodiment.

Fifth Exemplary Embodiment

A description will be given of the spark plug according to the fifth exemplary embodiment of the present invention.

In the spark plug according to the fifth exemplary embodiment, the base material 50 of the earth electrode 5 is made of Ni alloy having a composition which is different from the composition of Ni alloy of the base material used in each of the spark plugs according to the first, second, third, and fourth exemplary embodiments previously described.

That is, the spark plug according to the fifth exemplary embodiment has the earth electrode 5 with the projected part 51 made of the base material 50. The base material 50 is made of Ni alloy composed of Ni of 71 wt %, Cr within a range of 14 to 17 wt %, and Fe within a range of 6 to 10 wt %.

The spark plug according to the fifth exemplary embodiment having the above structure has the same actions and effect of the spark plug according to the first exemplary embodiment.

First Experiment

A description will now be given of the first experiment according to the present invention with reference to Table 1 and Table 2.

The first experiment prepared first to fifth test samples of spark plugs. The first to fifth test samples correspond in structure to the spark plugs according to the first to fifth exemplary embodiment previously described.

The first experiment executed a bend test of the earth electrode in each of the first to fifth test samples.

The bend test executes a repetition of bending the earth electrode in each of the first to fifth test samples. That is, the bend test bends the earth electrode of each test sample shown in FIG. 5C and then extends the earth electrode of each test sample shown in FIG. 5B. These bending and extending processes were repeated many times.

The first experiment detected an adhesion capability of the plating layer 12 on the projected part 51 of the earth electrode 5 of each test sample. That is, the first experiment detected the occurrence of separation of the plating layer 12 from the projected part 51 of the earth electrode 5 in each test sample.

Figure 9:
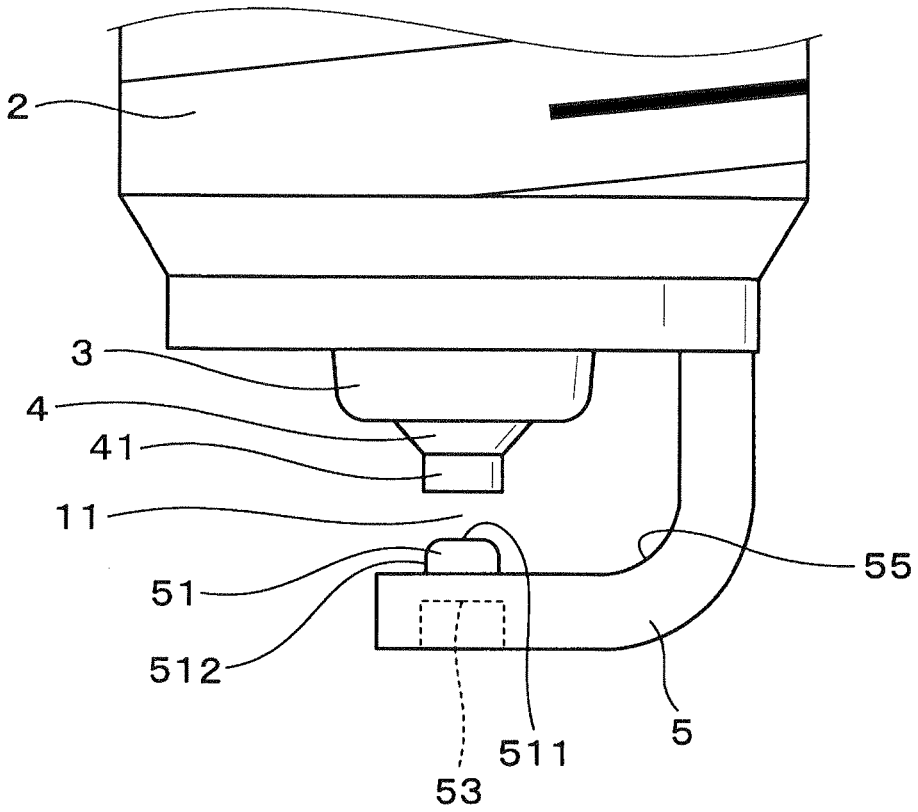
FIG. 9 is a side view showing the front part of the spark plug as a test sample according to a first experiment.

FIG. 9 is a side view showing the front part of each of the first to fifth test samples as the spark plugs used in the first experiment. Each of the first to fifth test samples had the following size and the bend test was executed under the following conditions:

The bent part of the earth electrode has a radius of curvature of 1.6 mm (tolerance of ±1.0 mm) when the earth electrode of each test sample was bent at the surface 55 of the earth electrode 5 on which the projected part 51 was formed;

The cross section of the earth electrode of each test sample which was cut along the longitudinal direction of the test sample had a rectangle shape, a wide "w" of 2.8 mm, and a thickness "t" of 1.6 mm as shown in FIG. 10;

The corner part 56 of the earth electrode 5 of each test sample had the radius of curvature of 0.3 mm;

The plating layer 12 in each test sample had a thickness within a range of 4 to 28 μm; and The plating layer 12 was formed by electro Ni plating.

Table 1 shows the chemical composition of the earth electrode of each of the first to fifth test samples. Table 2 shows the results of the bend test.

TABLE 1

(Chemical composition of Base material 50)

| Element (wt %) | First test sample (wt %) | Second test sample (wt %) | Third test sample (wt %) | Fourth test sample (wt %) | Fifth test sample (wt %) |
|---|---|---|---|---|---|
| Cr | <0.1 | 1.5-2.0 | 5-10 | 5-10 | 14-17 |
| Fe | <0.5 | <0.5 | <0.5 | 2-5 | 6.0-10.0 |
| Ni | 98 | 95 | 90 | 85 | 71 |
| Al | <0.1 | — | — | — | — |
| Mn | <0.1 | 1.0-1.25 | 1.0-1.25 | 1.0-1.25 | <1.0 |
| Y | 0.05-0.2 | — | — | — | — |
| Ti | 0.02-0.01 | — | — | — | — |
| C | — | <0.01 | <0.01 | <0.01 | <1.5 |
| Cu | — | <0.2 | <0.2 | <0.2 | <0.5 |
| Si | 0.7-1.3 | 1.0-1.25 | 1.0-1.25 | 1.0-1.25 | <0.5 |
| S | — | 0.01 | 0.01 | 0.01 | <0.015 |

TABLE 2

| | First test sample | | Second test sample | | Third test sample | | Fourth test sample | | Fifth test sample |
|---|---|---|---|---|---|---|---|---|---|
| Number of bend test | 1 | 4 | 1 | 4 | 1 | 4 | 1 | 3 | 1 |
| Occurrence of separation of plating layer from projected part | None | None | None | None | None | None | None | Presence | Presence |

As can be understood from the detection results shown in Table 2, no separation of the plating layer 12 from the projected part occurred in the first test sample, the second test sample and the third test sample after the fourth bend test, specifically, after the earth electrode was bent four times. The base material 50 of each of the first test sample, the second test sample and the third test sample were broken after the fourth bend test of the earth electrode 5, specifically, after the earth electrode 5 was bent five times.

On the other hand, the plating layer 12 of the fourth test sample was separated from the projected part 51 thereof after the second bend test of bending the earth electrode, specifically, after the earth electrode was bent two times. Further, the plating layer 12 of the fifth test sample was separated from the projected part 51 thereof after the first bend test of bending the earth electrode, specifically, after the earth electrode was bent once only.

From the above results of the bend test, it can be understood that each of the first test sample, the second test sample and the third test sample having the base material 50 of a high chemical composition of Ni has a superior and strong adhesion capability of the plating layer 12 onto the projected part 51. Specifically, it is possible for the plating layer 12 to have a strong adhesion onto the projected part 51 when the base material 50 is composed of not less than 90 wt % Ni.

For example, it is preferable for the base material 50 of the earth electrode 5 of the spark plug to contain Ni within a range of 80 to 98 wt %.

Although there is no occurrence of generating any bending stress in the plating layer 12 formed on the facing surface 511 of the projected part 51 of the earth electrode 5 of the spark plug in ordinary use, it is preferable for the spark plug to have the structure of each of the first test sample, the second test sample and the third test sample (which correspond to the spark plugs according to the first to third exemplary embodiment, respectively) in which no separation of the plating layer 12 from the projected part 51 of the earth electrode 5 was occurred. That is, the structure of the first test sample, the second test sample and the third test sample guarantees the strong adhesion capability of the plating layer 12 formed on the facing surface 511 of the projected part 51 of the earth electrode 5.

There is a possibility of separating the played layer 12 formed on the surface of the earth electrode 5 other than the facing surface 511 of the projected part 51. This decreases an appearance of the spark plug 1 and the separated plating layer 12 would cause contamination to the internal combustion engine, to which the spark plug is installed, and to various devices around the internal combustion engine. Accordingly, in view of the outer appearance of the spark plug and contamination to peripheral devices, it is preferable to use the spark plugs having a strong adhesion capability of the plating layer 12 to the projected part 51 of the earth electrode 5, which correspond to the first test sample and the second test sample (or correspond to the first exemplary embodiment and the second exemplary embodiment).

Sixth Exemplary Embodiment

A description will be given of the spark plug 1-1 according to the sixth exemplary embodiment of the present invention with reference to FIG. 11 and FIG. 12.

Figure 11:
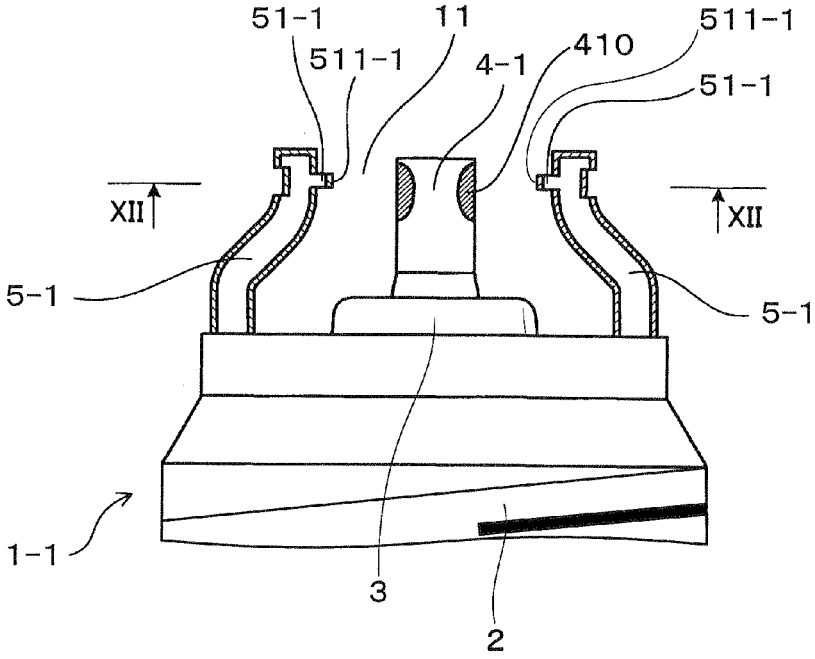
FIG. 11 is an enlarged view showing a longitudinal cross section of a front part of a spark plug according to a sixth exemplary embodiment of the present invention.

FIG. 11 is an enlarged view showing a longitudinal cross section of a front part of the spark plug 1-1 according to the sixth exemplary embodiment of the present invention. FIG. 12 is a view showing a cross section along the line XII-XII shown in FIG. 11.

Figure 12:
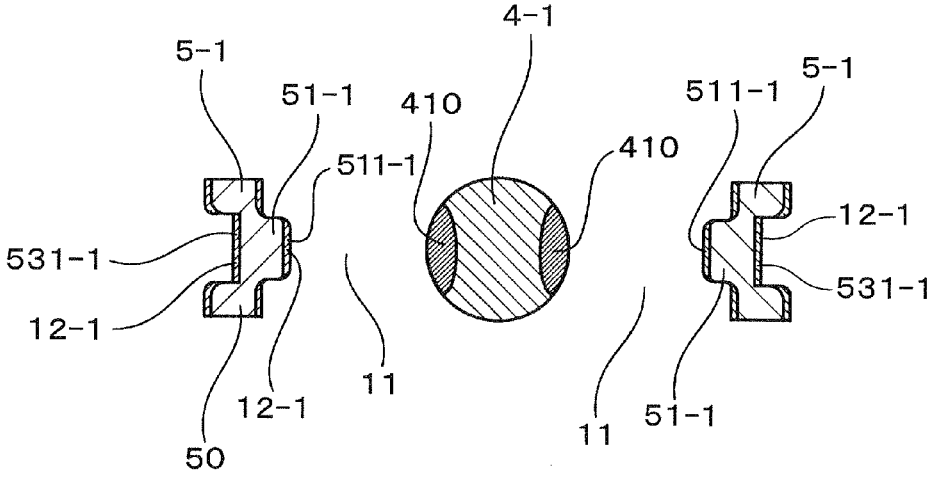
FIG. 12 is a view showing a cross section along the line XII-XII shown in FIG. 11.

As shown in FIG. 11 and FIG. 12, the spark plug 1-1 has two earth electrodes 5-1. Each of the earth electrodes 5-1 has a projected part 51-1 so that the projected part 51-1 of each earth electrode 51 faces a corresponding noble metal part 410 formed on the side surface of the central electrode 4-1. That is, each projected part 51-1 projects toward the corresponding noble metal part 410 formed on the side surface at a front part of the center electrode 4-1. As shown in FIG. 11 and FIG. 12, the spark plug 1-1 according to the sixth exemplary embodiment has two spark discharge gaps 11. Each spark discharge gaps 11 are formed between the facing surface 511-1 of each projected part 51-1 and the corresponding noble metal part 410 formed on the side surface of the center electrode 4-1.

In particular, the noble metal parts 410 formed on the side surface of the center electrode 4-1 are made of one of Ir, Rh, Ru, etc., for example.

Other components of the spark plug 1-1 according to the sixth exemplary embodiment are the same of these of the spark plug 1 according to the first exemplary embodiment previously described.

The structure according to the sixth exemplary embodiment shown in FIG. 1 and FIG. 12 allows the spark plug 1-1 to have the two spark discharge gaps 11. This structure makes it possible to provide the spark plug having an increased and superior sparkability and ignitability.

Seventh Exemplary Embodiment

A description will be given of the spark plug 1-2 according to the sixth exemplary embodiment of the present invention with reference to FIG. 13.

Figure 13:
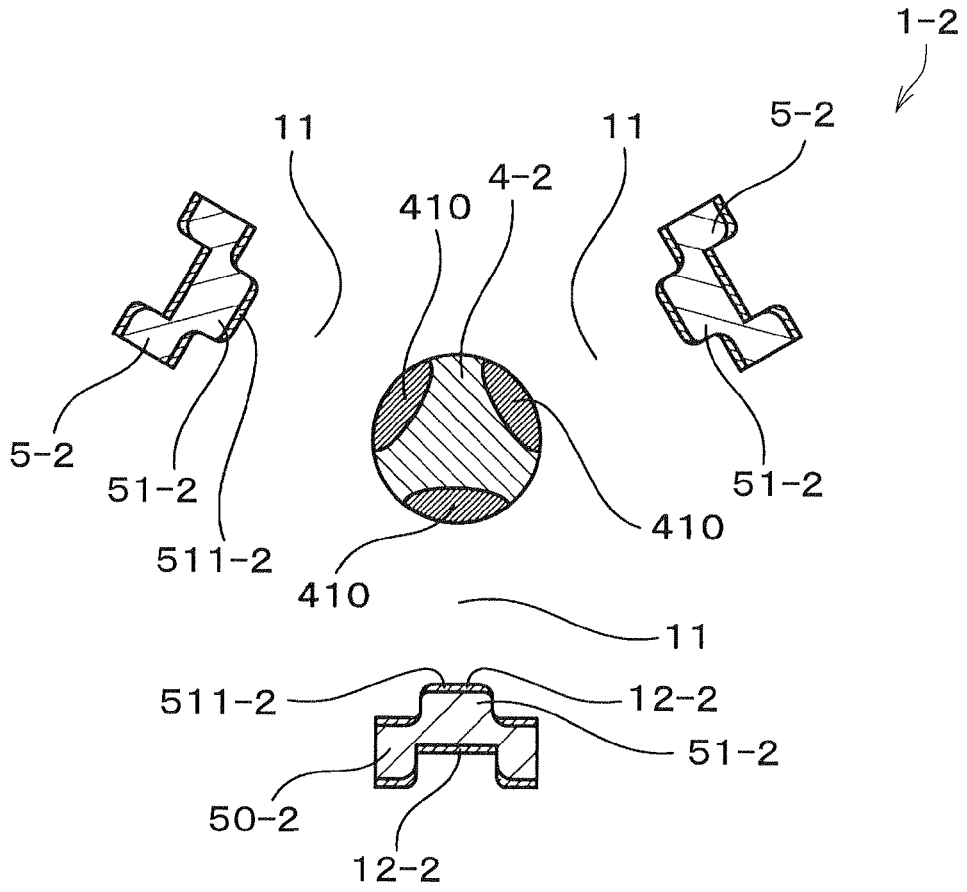
FIG. 13 is a view showing a cross section of a front part of a spark plug, which is perpendicular to an axial direction of the spark plug according to a seventh exemplary embodiment of the present invention.

FIG. 13 is a view showing a cross section of a front part of the spark plug 1-2, which is perpendicular to an axial direction of the spark plug 1-2 according to the seventh exemplary embodiment.

As shown in FIG. 13, the spark plug 1-2 according to the seventh exemplary embodiment has three earth electrodes 5-2. Each of the earth electrodes 5-2 has a projected part 51-2 so that the projected part 51-2 of each earth electrode 51-2 faces a corresponding noble metal part 410 formed on the side surface of the central electrode 4-2. That is, each projected part 51-2 projects toward the corresponding noble metal part 410 formed on the side surface at a front part of the center electrode 4-2. As shown in FIG. 13, the spark plug 1-2 according to the seventh exemplary embodiment has three spark discharge gaps 11-2. Each spark discharge gaps 11-2 is formed between the facing surface 511-2 of each projected part 51-2 and the corresponding noble metal part 410 formed on the side surface of the center electrode 4-2.

In particular, the noble metal parts 410 formed on the side surface of the center electrode 41—is made of one of Ir, Rh, Ru, etc., for example.

Other components of the spark plug 1-1 according to the sixth exemplary embodiment are the same of these of the spark plug 1 according to the first exemplary embodiment previously described.

Similar to the sixth exemplary embodiment, the structure according to the seventh exemplary embodiment shown in FIG. 13 allows the spark plug 1-2 to have the three spark discharge gaps 11. This structure makes it possible to provide the spark plug having an increased and superb sparkability and ignitability.

Although the first exemplary embodiment shows the spark plug 1 having the single earth electrode 5, and the sixth exemplary embodiment shows the spark plug 1-1 having the two earth electrodes 1-1, and the seventh exemplary embodiment shows the spark plug 1-2 having the three earth electrodes 5-2, the concept of the present invention is not limited by the above exemplary embodiments. For example, it is possible for the spark plug to have one or more earth electrodes.

Further, although the first to sixth exemplary embodiments show the plating layer 12 made of Ni, the concept of the present invention is not limited by the above exemplary embodiments. For example, it is possible to use the plating layer made of metal such as Zn, Cr, etc. other than Ni.

Still further, although the first to sixth exemplary embodiments show the facing surface 511 having an approximate flat surface of the projected part 51 of the earth electrode 5, the concept of the present invention is not limited by the above exemplary embodiments. For example, it is possible for the facing surface of the projected part to have one of a projected curved surface, a steeple shape, a multi-step shape, etc. In these cases, the facing surface with which the plating layer 12 is covered is formed on the area which is most close to the center electrode in the spark discharge gap. The side surface of the projected part of the earth electrode is formed around the area in which the facing surface with which the plating layer 12 is formed.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug comprising:

a cylindrical housing case;

a cylindrical glass insulator supported by an inside of the cylindrical housing case;

a center electrode supported in the inside of the cylindrical glass insulator so that a front part of the center electrode is exposed toward the outside of the spark plug; and an earth electrode fixed to the cylindrical housing case, wherein:

the earth electrode has a projected part projected toward the center electrode, the projected part of the earth electrode has a facing surface which faces the center electrode and is closest to a front part of the center electrode in a spark discharge gap, the spark discharge gap is formed between the center electrode and the earth electrode, and the facing surface of the projected part of the earth electrode is covered with a plating layer, and a base material, with which the earth electrode is made, is exposed on a side surface of the projected part around the facing surface of the projected part of the earth electrode; and the plating layer is made of Ni, and the base material of the earth electrode is made of Ni alloy containing not less than 90 wt % Ni.

2. The spark plug according to claim 1, wherein the projected part of the earth electrode is produced by extracting the earth electrode so that the projected part is extracted by a pressure from the surface of the earth electrode toward the center electrode in the spark discharge gap.

3. The spark plug according to claim 1, wherein the earth electrode has a plurality of the projected parts and the center electrode has a plurality of the noble metal parts, the projected parts are arranged around the noble metal parts, and the projected parts and the noble metal parts are in one-to one correspondence.

4. A spark plug comprising:

a cylindrical housing case;

a cylindrical glass insulator supported by an inside of the cylindrical housing case;

a center electrode supported in the inside of the cylindrical glass insulator so that a front part of the center electrode is exposed toward the outside of the spark plug; and an earth electrode fixed to the cylindrical housing case, wherein:

the earth electrode has a projected part projected toward the center electrode, the projected part of the earth electrode has a facing surface which faces the center electrode and is closest to a front part of the center electrode in a spark discharge gap, the spark discharge gap is formed between the center electrode and the earth electrode, and the facing surface of the projected part of the earth electrode is covered with a plating layer, and a base material, with which the earth electrode is made, is exposed on a side surface of the projected part around the facing surface of the projected part of the earth electrode;

the plating layer is made of Ni, and the base material of the earth electrode is made of Ni alloy containing not less than 90 wt % Ni; and the base material of the earth electrode is made of Ni alloy containing Ni within a range of 90 wt % to 98 wt %.

5. A spark plug comprising:

a cylindrical housing case;

a cylindrical glass insulator supported by an inside of the cylindrical housing case;

a center electrode supported in the inside of the cylindrical glass insulator so that a front part of the center electrode is exposed toward the outside of the spark plug; and an earth electrode fixed to the cylindrical housing case, wherein:

the earth electrode has a projected part projected toward the center electrode, the projected part of the earth electrode has a facing surface which faces the center electrode and is closest to a front part of the center electrode in a spark discharge gap, the spark discharge gap is formed between the center electrode and the earth electrode, and the facing surface of the projected part of the earth electrode is covered with a plating layer, and a base material, with which the earth electrode is made, is exposed on a side surface of the projected part around the facing surface of the projected part of the earth electrode;

the plating layer is made of Ni, and the base material of the earth electrode is made of Ni alloy containing not less than 90 wt % Ni; and the projected part of the earth electrode is produced by extracting the earth electrode so that the projected part is extracted by a pressure from the surface of the earth electrode toward the center electrode in the spark discharge gap.

* * * * *